United States Patent [19]
Flum

[11] Patent Number: 4,478,337
[45] Date of Patent: Oct. 23, 1984

[54] ADJUSTABLE SHELVING UNIT

[75] Inventor: Paul Flum, University City, Mo.

[73] Assignee: Paul Flum Ideas, Inc., St. Louis, Mo.

[21] Appl. No.: 393,462

[22] Filed: Jun. 29, 1982

[51] Int. Cl.³ ..... A47F 7/00
[52] U.S. Cl. ..... 211/49 D; 211/126; 211/153; 206/564; 220/8; 108/114
[58] Field of Search ..... 211/49 D, 153, 128, 211/72, 126; 206/561, 564, 562, 563; 220/8; 248/221.2; 108/65, 64, 114

[56] References Cited

U.S. PATENT DOCUMENTS

| | | | |
|---|---|---|---|
| 1,389,973 | 9/1921 | O'Conner | 211/49 D |
| 3,310,271 | 10/1965 | King | 248/221.2 |
| 3,570,682 | 3/1971 | Elliott | 211/126 |
| 3,628,807 | 12/1971 | Fullington | 211/128 X |
| 3,887,102 | 6/1975 | Early | 220/8 |
| 3,927,769 | 12/1975 | Maslow et al. | 211/153 |
| 4,084,703 | 4/1978 | Hossalla et al. | 211/153 |
| 4,155,312 | 5/1979 | Thorkildson | 211/153 X |
| 4,314,648 | 2/1982 | Spamer | 211/49 D |

FOREIGN PATENT DOCUMENTS

| | | | |
|---|---|---|---|
| 43097 | 2/1970 | Finland | 211/49 D |
| 181049 | 10/1962 | Sweden | 211/153 |

*Primary Examiner*—Ramon S. Britts
*Assistant Examiner*—Blair Johnson
*Attorney, Agent, or Firm*—Haverstock, Garrett & Roberts

[57] ABSTRACT

A two-piece telescoping shelf adaptor construction adaptable to be supported on a shelf structure in a flat or inclined position and adjustable to accommodate varying shelf depths comprising first and second members each being formed having a similar number of spaced parallel adjacent guide channels extending thereacross, the first member having a front wall extending across the front edge thereof and the second member having a rear wall extending across the rear edge thereof, the guide channels each including a floor portion and spaced upstanding wall portions extending across the first and second members to form separators between the adjacent channels, the upstanding wall portions on the second member having cross-sectional shapes and being spaced to slidably receive and telescopingly cooperate with the upstanding wall portions on the first member whereby the first and second members can be moved relative to each other in order to achieve a desired length between the front wall of the first member and the rear wall of the second member, and at least one track member positioned in and extending along each of the channels in each of the first and second members to engage and support products positioned thereon, the floor portion associated with each of the adjacent guide channels also including a plurality of apertures located adjacent to the respective track members positioned therein for enabling air to pass therethrough for circulation around the rows of products positioned in each of the guide channels. These constructions can include self-lubricating tracks and can be used by inclining existing shelves to effect gravity feeding of products of various types, sizes and shapes.

19 Claims, 12 Drawing Figures

ADJUSTABLE SHELVING UNIT

The present invention relates to product display devices for use in storing and merchandising shelved products and, more particularly, to various embodiments of an adjustable shelving unit adaptable to be supported on a support structure for holding and merchandising products therefrom, the present devices including two relatively movable members which telescopingly cooperate with each other so that the overall length of the devices may be easily and conveniently adjusted to accommodate varying shelf depths. The present devices are ideally suited for use on conventional shelving commonly utilized in supermarkets, convenience stores, and other food and beverage outlets and each device includes a plurality of guide channels for guiding and maintaining products positioned in parallel rows therebetween, and product supporting track members disposed within and extending along the guide channels in each of the relatively movable members for slidably supporting products positioned thereon. The present shelving devices are primarily designed for use in refrigerated display cases and each includes means whereby refrigerated air can circulate around and between the rows of products positioned thereon. The present devices are likewise adaptable for use in a multiplicity of other display rack applications.

A wide variety of display devices have been designed and manufactured for use in merchandising shelved products to consumers. These display devices are commonly employed by supermarkets, convenience stores, and other retail stores for use in store display windows and other display areas to show and focus attention on the wares displayed therein. One of the major problems associated with storing and displaying shelved products for sale to customers and, in particular, shelved products requiring refrigeration in display coolers and other types of cold vaults, is the inefficient use of available shelf space and the inability of the merchant to constantly provide an attractive arrangement of shelved products which are readily visible and easily accessible to the customer at the front portion of the shelf. Typically, articles of merchandise, especially products such as numerous bottled and canned soft drinks which are packaged in a wide variety of container sizes and shapes, are randomly distributed and stacked in segregated areas on a shelf or other display device in such a manner that the selection of a particular goods item, access to that particular item, and the removability of that item from the shelf or display device by the customer becomes, at times, difficult if not impossible. Although various product shelving displays have been designed to alleviate some of the aforementioned problems associated with merchandising shelved products to consumers, all such devices suffer from certain disadvantages and shortcomings including being relatively large, bulky, awkward, expensive, and difficult, if not impossible, to use on the shelf space presently available in supermarkets and other retail outlets, including, more particularly, the shelf space available in conventional refrigerated display coolers. In addition, none of the known devices or methods for storing and merchandising shelved products are as simple structurally as the present constructions and none utilize as efficient and effective means for both improving the slidability and availability of products positioned thereon while allowing air to circulate around and between products positioned thereon which is especially important when the shelved products require refrigeration. Additionally, none of the known devices are adjustable to accommodate varying shelf depths.

The present product merchandising devices overcome many of the disadvantages and shortcomings associated with known display devices, and teach the construction and operation of a relatively simple shelving unit adaptable for use on and with existing shelving equipment, which unit includes first and second relatively movable members which, in combination, define a shelving device having opposed front and rear walls and a plurality of spaced parallel guide channels extending therebetween for guiding and maintaining products positioned thereon. The first member is preferably of a one-piece plastic molded construction and includes opposed front and rear edges, a floor portion extending therebetween, and a front wall extending substantially across the entire length of the front edge thereof. The first member also includes a plurality of parallel guide members extending substantially along the entire length of the floor portion between the front and rear edges defining a plurality of parallel adjacent guide channels for organizing and guiding products positioned therein in parallel rows therebetween. A track member is attachable to the floor portion of the first member in each respective guide channel and likewise extends along the full length thereof forming a support bottom in each channel for supporting products positioned thereon. The track members are specifically constructed to accommodate and support any and all products positioned thereon regardless of the shape of their bottom wall surface and likewise include means for improving the slidability of products positioned thereon.

Each of the present shelving devices also includes a second member preferably of a one-piece plastic molded construction having opposed front and rear edges, a floor portion extending therebetween, and a rear wall extending substantially across the entire length of the rear edge thereof. Like the first member, the second member includes a similar plurality of parallel guide members extending substantially along the entire length of the floor portion between the front and rear edges thereof defining a similar plurality of parallel adjacent guide channels for guiding and maintaining products positioned therein. Similar track members are attached to the floor portion of the second member in each respective guide channel and extend along substantially the full lengths thereof and to a position extending beyond the front edge of the second member. The parallel guide members of the second member have cross-sectional shapes which are adaptable for slidably receiving the parallel guide members of the first member to enable the members to be arranged in a telescoping relationship with each other, the plurality of guide channels associated with the first member being in alignment with the plurality of guide channels associated with the second member to form continuations thereof. This telescoping feature allows a user to be able to easily adjust the overall length of the subject devices so as to accommodate varying shelf depths and, more particularly, it allows the subject devices to be utilized in conjunction with a wide variety of existing shelf space presently available in supermarkets, convenience stores, and other retail outlets. Once positioned in telescoping engagement with each other, portions of the track members associated with the second member extend above and overlap portions of the track members associated with the first member so that products positioned thereon will be able to move or slide therealong from the rear wall of the second member to the front wall of the first member in a smooth, steady, and uninhibited manner without hang up or other interference from the points of joinder between the first and second members. The present devices therefore provide adjustable shelving units which maximize utilization of existing shelf space while at the same time organizing and arranging the various products displayed therein for easy selection and access by the customer. Such an orderly arrangement of products also facilitates stocking and product rotation and also aids in identifying and controlling inventory. Use of the present devices are also cost effective because they are adaptable for use with existing shelving and require no additional parts.

The present shelving devices further include a plurality of apertures formed through the floor portions thereof, the apertures being arranged and positioned at locations to enable efficient circulation of air through the device and adjacent to the products positioned thereon. This means for venting refrigerated air through the first and second members and around the products positioned thereon makes the subject devices particularly advantageous for use in refrigerated display coolers and other types of cold vaults commonly found in supermarkets, convenience stores, grocery outlets, fast food outlets, and a wide variety of other wholesale and retail stores. Because of the named features and capabilities, the present devices provide simple and efficient means for effectively utilizing already existing shelf space; they provide for the orderly and attractive arrangement and display of products; they provide means for adjusting the overall length of the subject devices so as to accommodate varying shelf depths; and they provide an effective means for enabling the circulation of refrigerated air around and between the rows of products positioned thereon when used in a refrigerated display cooler. These features are particularly important to merchants because they increase the accessibility to the customer of products being displayed and marketed thereon and they more effectively and attractively utilize available shelf space, all of which promotes sales.

In addition, alternative embodiments include various front wall configurations associated with the front or first member, each of the various front wall configurations serving as a forward stop means for holding and retaining products positioned within the respective channels until such products are removed therefrom. The front walls are also designed to expose as much of the products as possible to view and to facilitate the customer reaching into the segregated channels to grip a product being removed. Other embodiments of the subject shelving unit include track means which are integrally formed within the respective floor portions of the first and second relatively movable members. Additionally, since all of the various embodiments of the present invention include track means to improve the slidability of products positioned thereon, and most embodiments are preferably utilized on an inclined supporting structure to achieve a gravity feed system whereby the remaining products positioned within each respective guide channel are continuously maintained adjacent the front wall for easy access and removal by the customer. There is also the further possibility for some embodiments to be used in horizontal position simply to organize the products positioned thereon. In these cases, product movement due to gravity is not important. In an effort to convert existing horizontal shelf space into gravity feed type shelving, means in the form of special adapter hooks adaptable for use with certain types of conventional shelving are disclosed. These hooks can be used to raise one end of an existing horizontal shelf to incline it so that the present devices can be positioned and supported thereon in an inclined gravity feed manner so that products placed within the subject devices will automatically slide along the track means towards the front ends thereof. Although it is anticipated that the various embodiments of the present shelving unit will be utilized primarily in refrigerated display coolers, the present devices are likewise adaptable for use in other merchandising rack applications.

It is therefore a principal object of the present invention to provide an efficient and attractive shelving unit adaptable for storing and merchandising a wide variety of shelved products.

Another object is to provide a product merchandising unit that is structurally and operationally relatively simple and inexpensive to make and install.

Another object is to provide a product merchandising unit having means associated therewith for enabling effective circulation of refrigerated air around and between the products positioned thereon.

Another object is to provide a shelving unit wherein the overall length thereof is adjustable to be accommodated on various depth shelves.

Another object is to provide an adjustable shelving unit which more effectively utilizes available shelf space or merchandising areas, including shelf space associated with refrigerated display coolers.

Another object is to provide an adjustable shelving unit which attractively organizes the products positioned therein in parallel rows for attractive display and for easy access and removal.

Another object is to provide an improved product display unit adaptable for use with existing shelf systems commonly utilized in supermarkets and other merchandising centers, including shelf systems associated with refrigerated display coolers.

Another object is to provide an adjustable shelving unit which includes track means capable of slidably supporting a wide variety of shelved products.

Another object is to provide an adjustable shelving unit which includes means for improving the slidability of products positioned thereon.

Another object is to teach the construction of a product merchandising unit which can be easily and quickly refilled from either the front or rear.

Another object is to provide a product merchandising unit which, when positioned on an inclined supporting structure, provides a gravity feed system whereby a supply of the shelved products is always maintained at the front of the unit.

Another object is to provide means for converting an existing used product merchandising shelf to a like-new appearing unit.

Another object is to provide a merchandise display shelf that is relatively easy to clean, maintain, install, and replace.

These and other objects and advantages of the present invention will become apparent to those skilled in the art after considering the following detailed specification which discloses several representative embodiments of the present shelving unit in conjunction with the accompanying drawings, wherein.

Figure 7:
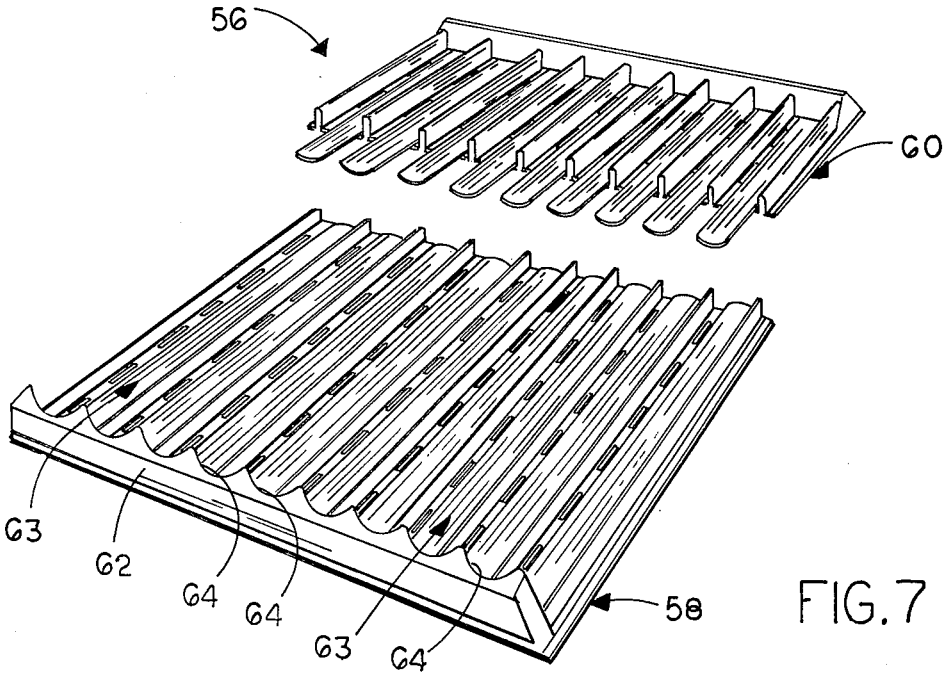
Figure 8:
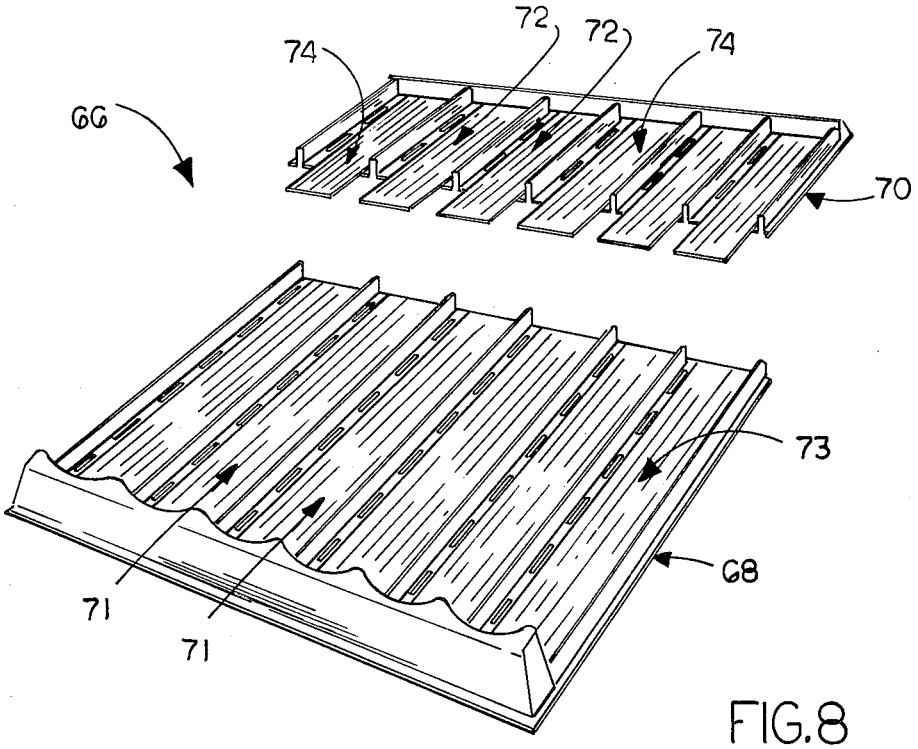
Figure 9:
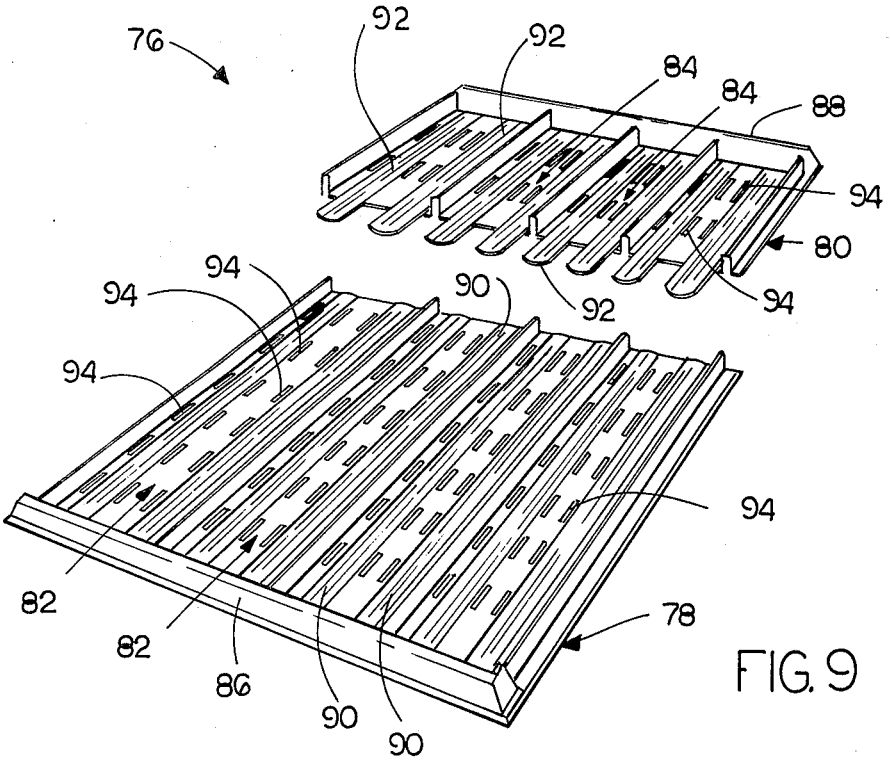
Figure 10:
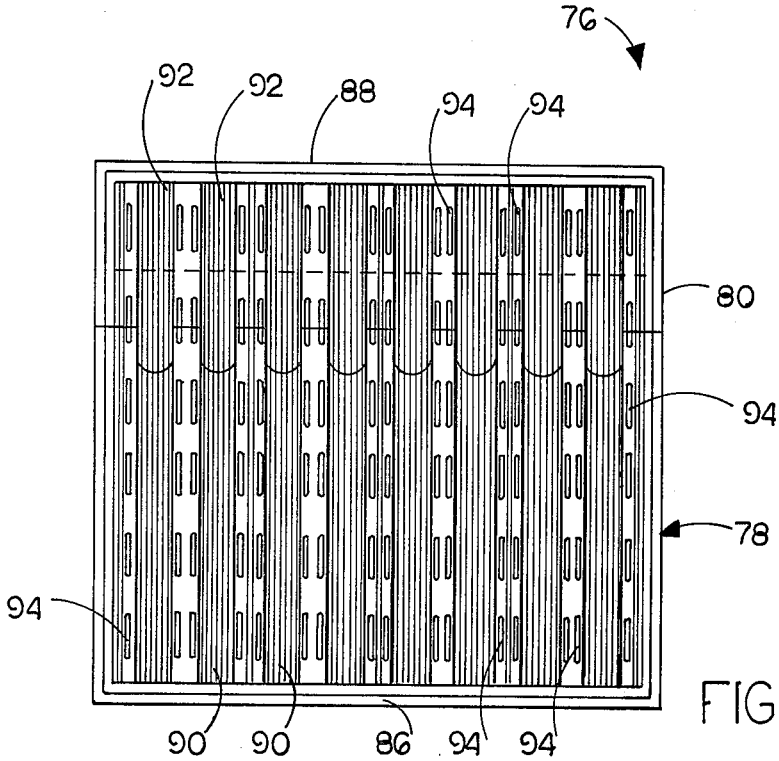

FIGS. 7, 8, and 9 are exploded perspective views showing other embodiments of the subject shelving device;

FIG. 10 is a top plan view of the shelving device of FIG. 9; and

Figure 11:
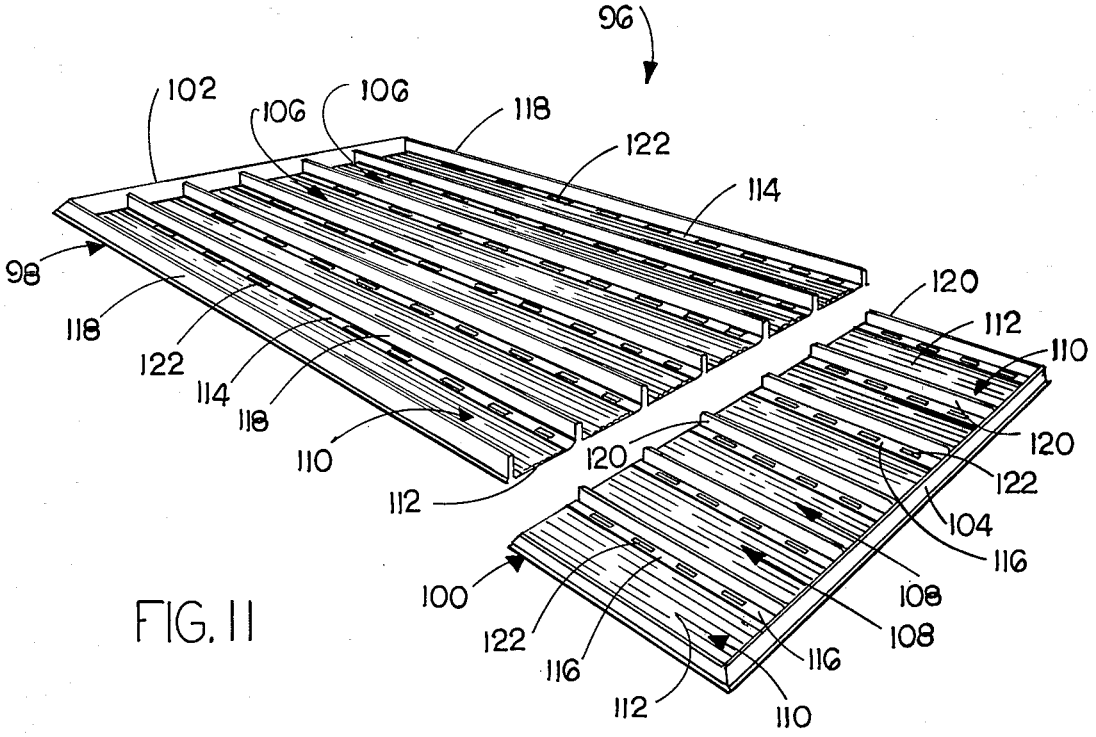
Figure 12:
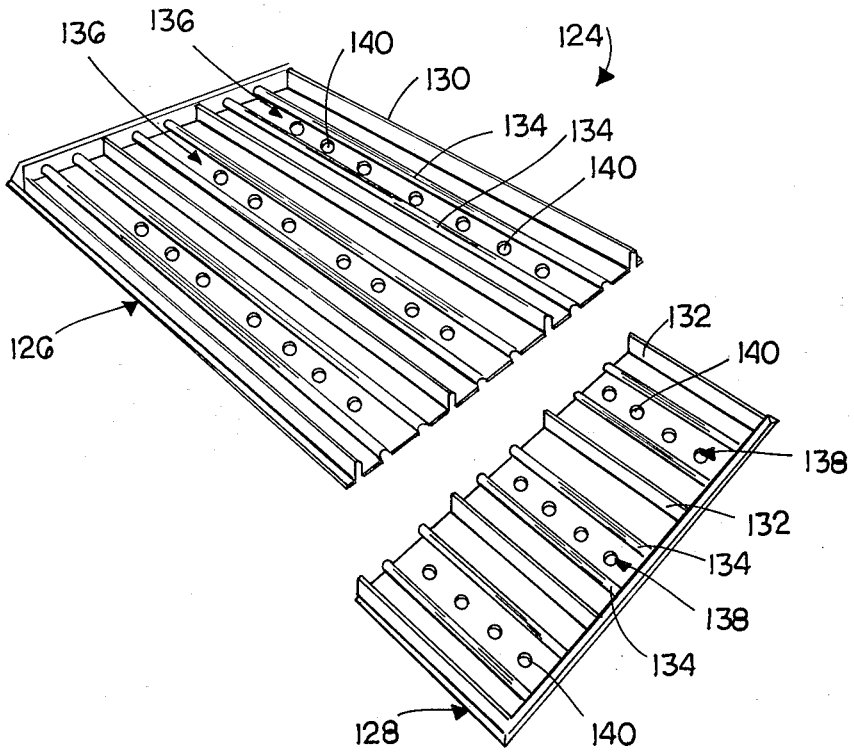

FIGS. 11 and 12, are perspective views showing still other embodiments of the subject device wherein the track means are integrally formed therewith.

Figure 1:
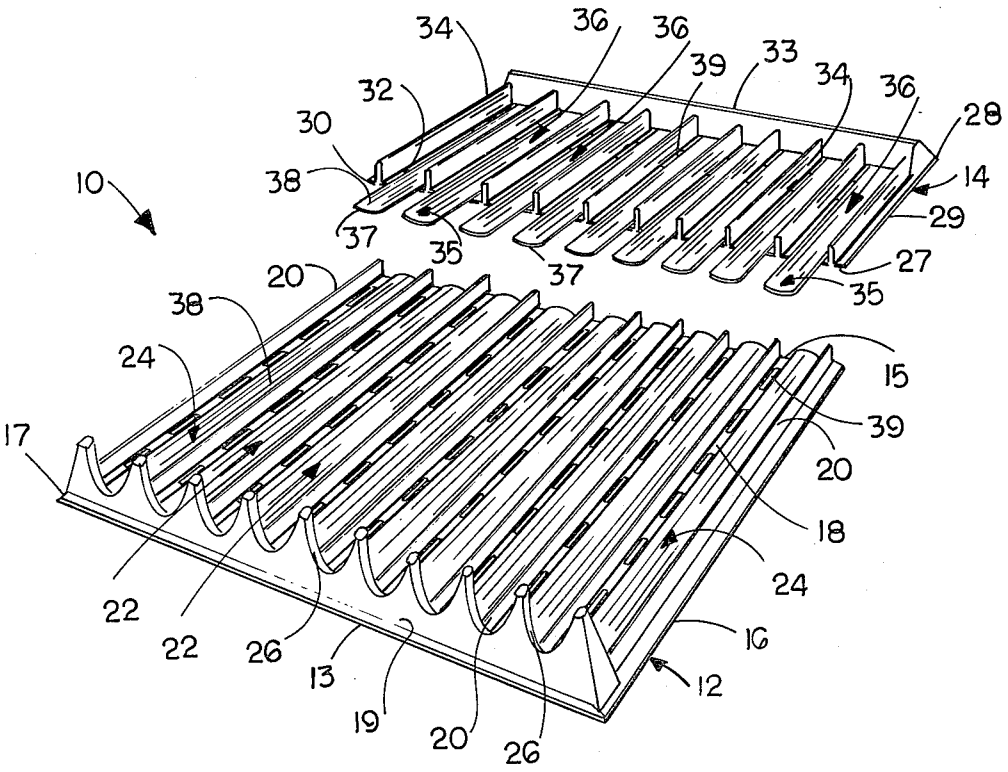
FIG. 1 is an exploded perspective view showing a product display device constructed according to the teachings of the present invention.
Figure 2:
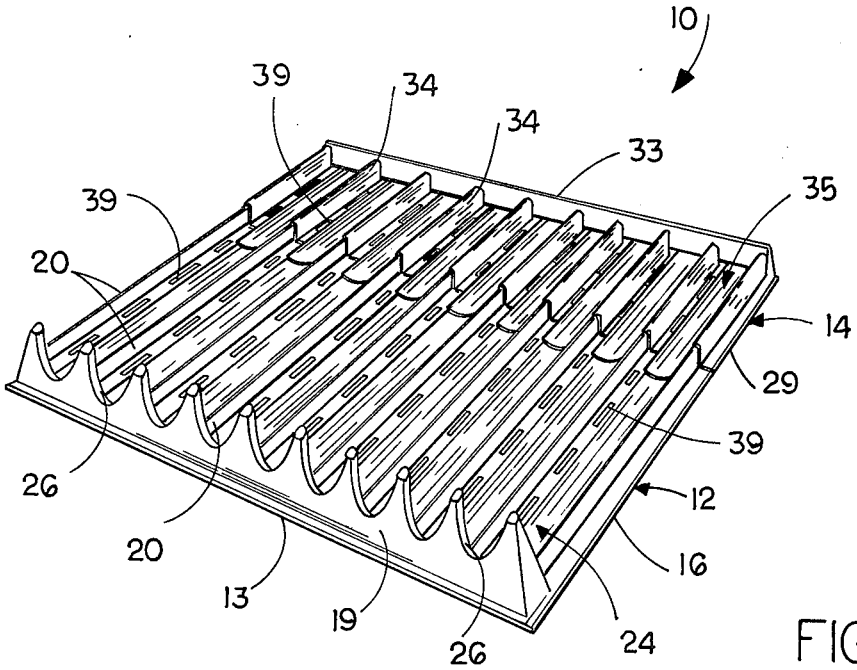
FIG. 2 is a perspective view showing the shelving device of FIG. 1 in assembled condition.
Figure 3:
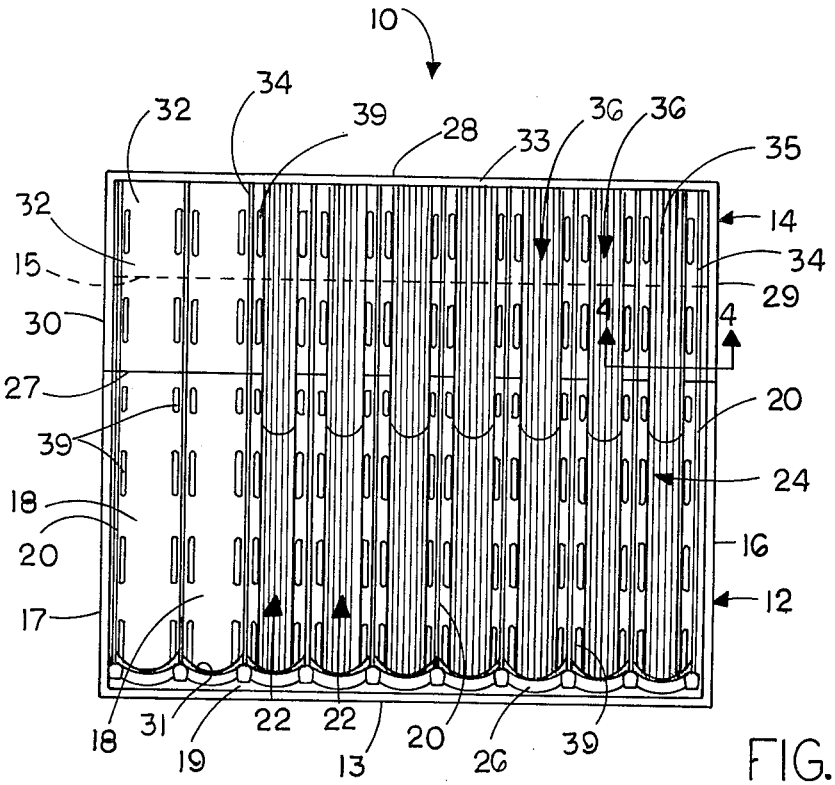
FIG. 3 is a top plan view of the shelving device of FIG. 2.

Referring to the drawings more particularly by reference numbers, wherein like numerals refer to like parts, number 10 in FIGS. 1–3 identifies an adjustable shelving unit constructed according to the teachings of the present invention. The shelving display device 10 is specifically designed for storing and merchandising products such as bottled and canned soft drink products and the like, and comprises a two-piece telescoping structure formed by first and second members 12 and 14 which in combination are adjustable to change the size of the load carrying surface and together define a generally rectangular shelving device adaptable for use on a support structure such as on shelving commonly used in supermarkets and in a wide variety of other food and beverage outlets, including shelving associated with refrigerated display coolers and cases and other cold storage merchandising vaults. The member 12 is preferably of one-piece plastic molded construction and includes opposite front and rear edges 13 and 15, opposed side edges 16 and 17, a floor portion 18 extending substantially the full length and width of the member 12 between the front, rear, and side edges, and a front wall 19 extending along the front edge 13 as shown in FIGS. 1–3. The rear end portion of the member 12 adjacent to the rear edge 15 is open and no wall means extends thereacross. The member 12 also includes a plurality of spaced upstanding wall portions or partitions 20 that likewise extend substantially along the full length of the floor portion 18 between the front wall 19 and the rear edge 15 defining therebetween a plurality of parallel channels 22 for supporting products positioned therebetween in parallel rows. Each of the guide channels 22 is defined in part by a portion of the floor 18 as best shown in FIG. 3. It is preferred that the front wall 19 and the partitions 20 be integral with the floor 18 to simplify the construction and to lend structural integrity and stability to the member 12, although any means could be used for attaching the various portions together if desired. Track members 24 are attached to each of the respective guide channels 22 and extend along the length of the floor portions 18 between the front wall 19 and the rear edge 15 as shown in FIGS. 1–3. The track members 24 are preferably adhesively attached to the floor 18 and form the support surfaces on which merchandise rests and slides. Any suitable attachment means can be utilized to secure the track members 24 to the floor 18, and the attachment means should be such as to prevent relative movement and looseness between the track members 24 and the floor 18. Certain known types of glues or adhesives can be used to make a quick and efficient attachment of the members 24. The track members 24 may likewise be either permanently or removably installed within the guide channels 22, as desired.

The front wall 19 of the member 12 is formed to include a plurality of inverted arches 26 as clearly shown in FIGS. 1 and 2. The inverted arches 26 are uniformly disposed across the length of the front wall 19 and are positioned respectively adjacent to the front end of each guide channel 22. Besides enhancing the aesthetic appearance of the member 12, the arches 26 serve as stop means for products positioned within their respective channels 22 until such products are removed therefrom. The arches 26 also, and importantly, expose a relatively large area of the products positioned at the front of each row and the arches are shaped to also facilitate the customer reaching into the device to take hold of and remove a product therefrom. The rear surface of the front wall 19 in each channel 22 also has a curved surface 31 (FIG. 3) which mates with the contour of the articles positioned therein and forms a stop against which the front article in each channel comes to rest. In this latter regard, it is preferred that the edges of the arches 26 be rounded so that they will be smooth against the customer's hand and not rub or cause injury.

The rear member 14 is also preferable of one-piece plastic molded construction and includes opposed front and rear edges 27 and 28, opposed side edges 29 and 30, a floor portion 32 extending substantially the full length and width of the member 14 between the front, rear and side edges, and a rear wall 33 extending along the rear edge 28 as shown in FIGS. 1–3. In contrast to the member 12, the front instead of the rear end portion of the member 14 adjacent to the front edge 27 is open and no wall means extends thereacross. The member 14 likewise includes a plurality of spaced upstanding wall portions or partitions 34 that extend substantially the length of the floor portion 32 between the rear wall 33 and the front edge 27 defining therebetween a similar number of parallel guide channels 36 for supporting and guiding products positioned therebetween in parallel rows. Like the guide channels 22, each of the guide channels 36 is defined in part by a portion of the floor 32. It is also preferred that the rear wall 33 and the dividers 34 be integrally formed with the floor 32 for the same reasons hereinbefore discussed with reference to the wall portions 20. Track members 35 similar to the track members 24 are attached to the floor 32 in each of the respective guide channels 36 and extend along the full length thereof to a position beyond the front edge 27 as best shown in FIG. 1. The members 35 may likewise be adhesively attached to the floor 32 and they may be either permanently or removably installed within the guide channels 36 as hereinbefore discussed.

Figure 4:
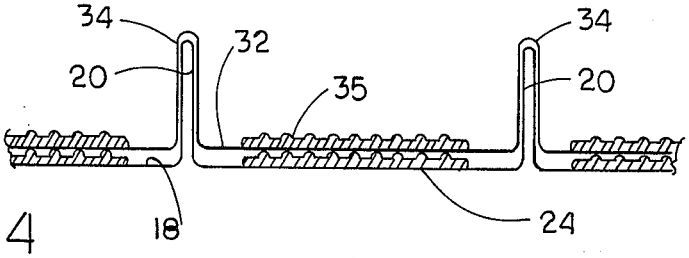
FIG. 4 is an enlarged fragmentary cross-sectional view taken along lines 4—4 of FIG. 3.

The upstanding wall portions or dividers 34 associated with the member 14 are substantially U-shaped in cross-section and are adaptable to slidably receive and telescopingly cooperate with the wall portions or dividers 20 associated with the member 12 as best shown in FIGS. 1 and 4. When positioned in telescoping relationship with each other, the members 12 and 14 are capable of being slidably movable relative to each other to adjust the overall length of the structure. When so positioned, the channels 36 lie in alignment with the channels 22 to form continuations thereof. This telescoping feature allows a user to conveniently adjust the overall distance between the front wall 19 and the rear wall 33 to accommodate varying shelf depths used for supporting the subject devices including shelving presently available in supermarkets and other retail outlets. In addition, when the members 12 and 14 are telescopingly engaged, the track members 35 associated with the member 14 extend atop and overlap the track members 24 associated with the member 12 as shown in FIGS. 2 and 3. This overlapping of the track members 24 and 35 allows products positioned on the rear member 14 to freely move along the track members towards the front wall 19 without impedence or other interference. This overlapping of the members 24 and 35 facilitates use of the subject device 10 as part of a gravity feed type system as will be hereinafter explained and provides a desirable condition whereby all of the remaining products positioned in each of the respective channels are always moved towards the front of the device along the respective track members in a steady, unrestricted manner for easy access and removal by the customers.

Each of the track members 24 and 35 includes a substantially flat base portion 37 having a plurality of spaced longitudinally extending ribs or runners 38 extending upwardly therefrom as shown in FIGS. 1–3. The track members 24 and 35 should be of a width less than the width of the floor portions 18 and 32 between the adjacent dividers 20 and 34 so that when attached to the floor portions there will be uncovered floor spaces along the opposite sides thereof. As explained in Applicant's U.S. Pat. No. 4,416,380 and co-pending application Ser. No. 369,102, filed Apr. 16, 1982, it is important that the spacing between the runners 38 be selected to be able to slidably support any and all of the various products that are to be positioned thereon regardless of the shape or contour of their bottom walls. Since many articles of merchandise are packaged in containers having unique and unusual shapes including unusual shapes or contours for their bottom surfaces, it is usually preferred to have the spacing between the runners 38 substantially uniform and relatively small across the width of the track members 24 and 35 so as to be able to accommodate many different bottom wall configurations. The specific spacing selected may be more important for some products than for others to reduce the possibility that they will overturn. The track members 24 and 35 are preferably of unitary construction and can be extruded or molded from a plastic material such as from high-impact polystyrene, polycarbonates, various nylons, rigid vinyl compositions, or polyesters. The use of the ribs or runners 38 is generally preferred over use of track members that have flat upper surfaces because the runners 38 in addition to providing support also reduce friction between the track members 24 and 35 and the products positioned thereon thereby improving the slidability of the products.

As likewise explained in Applicant's U.S. Pat. No. 4,416,380 and co-pending application Ser. No. 369,102, the materials used for making the track members 24 and 35 are preferably mixed with or impregnated with about 0.5% to 5% of a silicone substance to further improve their slidability characteristics. The impact polystyrene selected to be used in forming the track members 24 and 35 is preferably mixed with a minor percentage by weight of a silicone resin. The preferred silicone resins are those which mix most easily with the impact polystyrene and are characterized by being non-oxidizing, non-corrosive, non-toxic, and add lubricating properties to the impact polystyrene which is useful in the practice of this invention. While between about 0.5% to 5% silicone in the members 24 and 35 is desirable, greater or lesser amounts of silicone can be used depending on the desired slidability. The combination of polystyrene and silicone produces track members with runners that have relatively smooth slick surfaces exibiting self-lubricating characteristics which enable shelved products positioned thereon to move easily and smoothly therealong. Although not required with the present invention, the impregnation of silicone into the plastic substance used to make the track members 24 and 35 substantially reduces the possibility that products stored thereon will jam or stick and not slide, and it greatly facilitates use of the subject device 10 in a gravity feed type shelving display as when positioned on an inclined supporting structure as will be explained.

The construction of the present shelving device 10 also is such as to facilitate the circulation of air including refrigerated air through the device and around the products positioned thereon when installed in a refrigerated display case. This enables the present devices to be effectively utilized in refrigerated display coolers as well as in other environments thus further increasing their usefulness. To achieve this end, the floor portions 18 and 32 include a plurality of apertures 39 positioned within the respective guide channels 22 and 36 as shown in FIGS. 1–3. The apertures 39 are positioned such that they lie in longitudinal alignment on each opposite side of the respective track members 24 and 35 when said track members are attached to the respective guide channels 22 and 36. It is recognized that the particular shape and number of the apertures 39 can be varied considerably without departing from the teachings and practice of the present invention. Also, the greater the number and size of the apertures 39, the better will be the air circulating characteristics of the device 10.

Figure 5:
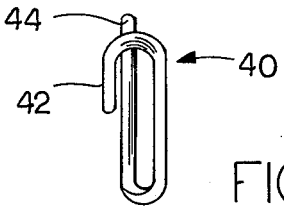
FIG. 5 is a perspective view of a hanger member utilized for supporting one corner of an existing shelf used for supporting the subject devices.

The present shelving device 10 can also be utilized as a gravity feed type shelving unit by positioning it on an inclined support structure. Certain known types of shelving systems such as the ARDCO and ANTHONY load carrying rack systems are particularly adaptable for conversion to a gravity feed type operation by simply elevating the rear portion of the shelves to achieve an inclination such that when the device 10 is positioned thereon, rows of products positioned on the respective track members 24 and 35 will slide under the force of gravity towards the front end of the rack. As explained in Applicant's U.S. Pat. No. 4,416,380 and co-pending application Ser. No. a 369,102, a track inclination or slope of between about 7° to 8° provides a desirable condition such that when the up-front product in one of the guide channels is removed, the remaining products positioned therebehind will automatically slide along the respective track members in a smooth and steady manner and without toppling over. However, with the present construction taking into account the products to be dispensed it has been found that a greater range of inclinations is possible including in a range from about 3° to about 11° relative to the horizontal. In order to incline certain types of conventional shelving to the desired inclination, adapter means such as the formed wire member 40 as shown in FIG. 5 are utilized. The adapter member 40 has two connected loop portions 42 and 44, which portions are angularly related to each other, and its use will be hereinafter explained.

Figure 6:
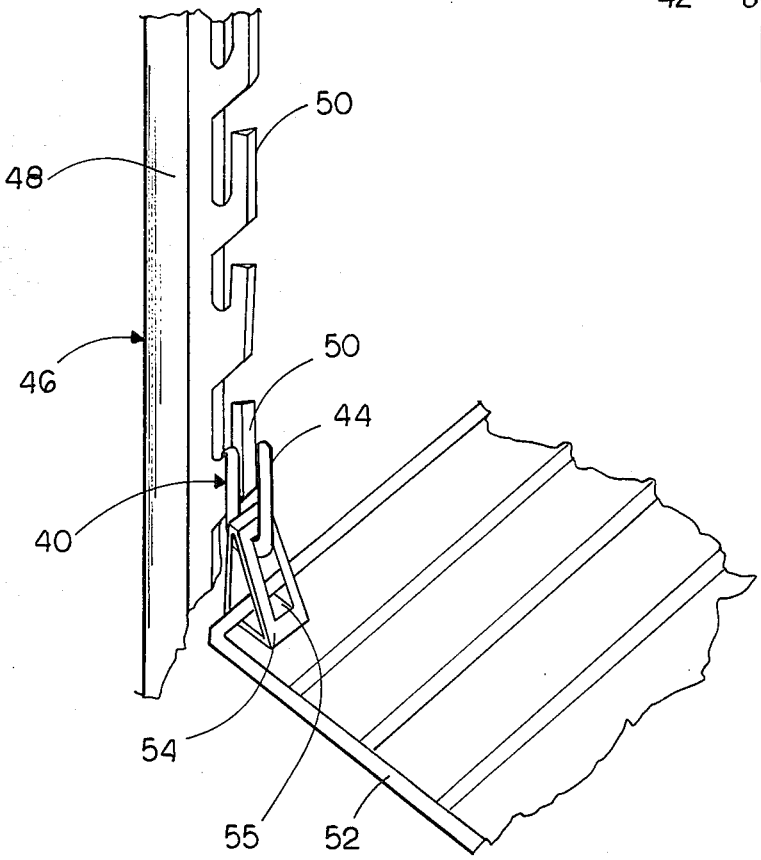
FIG. 6 is a fragmentary perspective view of an existing shelving member being supported by a hanger member such as the hanger member shown in FIG. 5.

Many known load carrying rack assemblies such as the ARDCO and ANTHONY systems are supported by means that are connected between the rack shelves and notches or openings formed in vertical support members located adjacent the corners thereof. The member 46 (FIG. 6) is typical of the type of vertical support members so located for supporting a shelf. The support member 46 is an elongated member 48 having a plurality of vertically spaced upwardly extending hooks 50, openings, or similar means formed therein. One of the loop portions 42 of the adapter member 40 is positioned extending over a selected one of the hooks 50 and the other oppositely facing loop portion 44 is used to engage means on the shelf 52 to support the shelf thereon. In particular, as shown the loop portion 44 is positioned extending through and being supported by an opening or slot 55 formed in the hanger member 54, one of which is hingedly attached to each corner of the shelf 52. It is also anticipated to have the loop portion 44 attached directly to an opening on the rear portion of the shelf 52 itself although use of a member such as the hanger member 54 enables greater possible angular support for the shelf. Use of the formed wire adapter members 40 in conjunction with the vertical support members located adjacent the rear corners of the individual shelves 52 enables a user thereof to easily adjust the elevation of the rear portion of the shelves 52 to achieve the proper inclination such that when the devices 10 are positioned thereon, products placed therewithin will automatically slide along the track members 24 and 35 towards the front wall 19 as explained above and in Applicant's U.S. Pat. No. 4,416,380 and co-pending application Ser. No. 369,102.

FIGS. 7, 8, and 9 disclose alternative embodiments of the shelving unit 10, each of which is specifically adaptable for use with a particular size and shape package or product container associated with the goods items to be displayed therein. In particular, FIG. 7 discloses an adjustable shelving unit 56 which is specifically adaptable for use in dispensing smaller and shorter single serve bottles than the construction shown in FIG. 1. Both constructions can also be used to dispense canned products such as soft drinks and fruit juices. The shelving unit 56 is substantially similar in construction and operation to the shelving device 10 disclosed in FIGS. 1–4, and includes a pair of telescopingly adjustable members 58 and 60. The member 58 differs from the member 12 mainly in the design of the front wall 62. The front wall 19 associated with the member 12, includes a plurality of curved portions 64, without the upwardly inverted arches 26, one such curved portion being associated with each row of products as shown in FIG. 7. The curved portions 64 are uniformly disposed across the length of the front wall 62 and are positioned respectively adjacent to the front end of each respective guide channel 63. The curved portions 64 are concave and extend only a relatively short distance above the floor portion of the member 58 to act as stops for products such as single serve bottles and cans of soft drinks and the like when positioned thereagainst. The concaved portions 64 also serve as a stop means for holding and retaining the products in the respective guide channels 63 until they are removed therefrom.

FIG. 8 discloses another embodiment 66 of the subject shelving unit wherein the width of the guide channels and the track members positioned therewithin are enlarged to accommodate the larger 2-liter bottles which are commonly used for packaging soft drinks. The shelving unit 66 includes a pair of telescopingly adjustable members 68 and 70 and is substantially similar in construction and operation to the shelving unit 56 disclosed in FIG. 7 but differs therefrom in that the guide channels 71 and 72 and the track members 73 and 74 positioned respectively therewithin are enlarged somewhat to accommodate the larger bottles. In other respects, the shelving unit 66 is constructed and arranged similarly to the shelving unit 56.

FIGS. 9 and 10 disclose still another modified shelving device 76 which is specifically adaptable for use in accommodating bottled and canned soft drinks which are packaged in conventional multi-pack containers such as are presently employed by the soft drink industry. The shelving unit 76 is similar in construction and operation to the shelving units hereinbefore described but differs therefrom in that the guide channels 82 and 84 associated respectively with the telescopingly adjustable members 78 and 80 are dimensioned so that each load supporting area has at least two track members such as the track members 90 and 92 located therein as shown in FIG. 10. The track members 90 and 92 may be similar to the track members 24 and 35 and are positioned in spaced relation within the respective guide channels 82 and 84 as shown. When the members 78 and 80 are positioned in telescoping engagement with each other, portions of the track members 92 extend above and overlap portions of the track members 90 as hereinbefore explained to form continuous tracks from front to rear. The spacing between the pairs of track members 90 and 92 should be such that when products packaged within a typical multi-pack container are positioned within the channels 82 and 84, each row of products within the multi-pack container will rest and slide along the respective pairs of track members 90 and 92. The spacing between the pairs of track members 90 and 92 may be varied to accommodate any particular pack size. The front and rear walls 86 and 88 may be the same as those disclosed above.

The shelving unit 76 also includes a plurality of apertures 94, like the apertures 39, which are positioned within the respective guide channels 82 and 84 and which extend through the device as shown in FIG. 10. The apertures 94 are shown positioned in rows on each opposite side of the track members 90 and 92 with two adjacent rows of apertures 94 being shown positioned in the space between the respective pairs of track members. This particular arrangement of the apertures 94 facilitates air circulation around and between the products positioned on the track members. Use of a double row of apertures 94 between the spaced track members within each respective guide channel is generally preferred over use of a single row of larger apertures therebetween because it adds to the overall strength of the device and to its load carrying capacity. The particular size, shape, and number of the apertures 94 may be varied as desired. It is also anticipated that even more track members may be positioned within each guide channel depending on the products to be supported.

FIGS. 11 and 12 disclose still other embodiments of the subject shelving unit wherein the product supporting track means are integrally formed therewith and wherein the devices are not designed to be used in a gravity feed situation, but rather are designed to organize the products on a horizontal surface for improved stock management and control. In particular, FIG. 11 discloses an adjustable shelving unit 96 which includes a pair of telescopingly adjustable members 98 and 100 which, in combination, define a shelving device having opposed front and rear walls 102 and 104 and a plurality of spaced aligned parallel guide channels 106 and 108 extending therebetween for supporting rows of products positioned thereon. Track means 110 in the form of a plurality of spaced longitudinally extending ribs or runners 112 are integrally formed with the respective floor portions 114 and 116 between adjacent wall portions or partitions 118 and 120 and extend substantially the full length of the respective channels 106 and 108. The track members like the divider walls also telescope into each other and this increases the strength of the device. Like the track members 24 and 35, the materials used for making the floor portions 114 and 116 may contain some silicone or other lubricant preferably in the proportions described above to improve the slidability although this is not as necessary in this construction because it is usually operated in a flat horizontal condition. The wall portions or dividers 118 associated with the front member 98 as distinguished from the rear member 100 are substantially U-shaped in cross-section and are adaptable to slidably receive and telescopingly cooperate with the wall portions or dividers 120 associated with the rear member 100. The shelving unit 96 also includes a plurality of apertures 122 positioned within each respective guide channel 106 and 108 adjacent to each opposite side of the track means 110 to facilitate circulation of air through the device and around and between the products positioned thereon as hereinbefore explained. Also note that the track means 110 associated with the rear member 98, unlike the track members associated with the rear members 14, 60, 70, and 80, extend only substantially the full length of each respective guide channel 106 but do not extend beyond the front edge thereof as in the previous constructions. Like the shelving units hereinbefore described, the members 98 and 100 are capable of being slidably movable relative to each other to adjust the overall length of the structure 96 to accommodate varying shelf depths.

FIG. 12 discloses a shelving unit 124 which is substantially similar in construction and operation to the shelving device 96 (FIG. 11) and includes a pair of telescopingly adjustable members 126 and 128 each having track means formed integrally therewith between upstanding wall portions or dividers 130 and 132. In this particular construction, the track means include a pair of spaced longitudinally extending ribs or runners 134 extending substantially the entire length of the respective guide channels 136 and 138. A plurality of apertures 140 are positioned within the respective guide channels 136 and 138 and between the spaced runners 134 formed therewithin to facilitate the circulation of air through the device and around and between the rows of products positioned thereon. Like the track means 110, the longitudinally extending runners 134 may include some silicone substance for reasons already stated.

Although it is recognized that various acceptable materials of construction are available and could equally be employed to construct the present devices, it is usually preferred that the devices be constructed from a relatively rigid plastic material that does not deteriorate when exposed to the elements and able to withstand moderate impact and mishandling without breakage. It is also recognized that certain metals, metal alloys, fiberglass, or even wood or other materials could be utilized in the practice of this invention but plastics have been found to be preferred. The selection of the material should take into account the type of products and their containers to be merchandised and the environment where the device is to be located. Additionally, the overall length and width of each of the front and rear members should be selected so that the devices will be accommodated by different shelf and product sizes and shapes. Likewise, any number of similar shelving devices may be arranged and/or connected adjacent to each other as required, thus increasing the usefulness and effectiveness of the subject devices. Furthermore, signage and other indicia may be applied to the front and/or rear wall portions of the devices for attractively advertising the particular goods items being sold and to aid the merchant when restocking the shelves.

Thus there has been shown and described several embodiments of a novel adjustable shelving unit for use in storing and merchandising shelved products, including products requiring refrigeration, which devices fulfill all of the objects and advantages sought therefor. Many changes, modifications, variations, and other uses and applications of the present construction will, however, become apparent to those skilled in the art after considering this specification and the accompanying drawings. All such changes, modifications, variations, and other uses and applications which do not depart from the spirit and scope of the invention are deemed to be covered by the invention which is limited only by the claims which follow.

What is claimed is:

1. An adjustable shelving unit for merchandising products arranged in rows, said unit being adapted to be positioned on a sloping surface to serve as a gravity feed product dispensing system comprising first and second relatively movable members each being formed having a similar number of spaced parallel adjacent channels extending thereacross in one direction and each having end wall means formed extending across one end thereof to form an end wall for the channels thereon, said channels including bottom wall portions and spaced upstanding side wall portions extending across said first and second members to form separators between the adjacent channels, the upstanding side wall portions on said second member having cross-sectional shapes adaptable for slidably receiving and engaging the upstanding side wall portions on said first member to enable said first and second members to be arranged in telescoping relationship with each other, said plurality of adjacent channels associated with said first member being in alignment with said plurality of adjacent channels associated with said second member when said members are engaged to form continuations thereof whereby said first and second members can be moved relative to each other to achieve a desired length for said channels, at least one product supporting track member positioned in and extending along the channels in each of said first and second members to engage and support products positioned thereon, the product supporting track members on said second member extending beyond one end of the channels formed therein to overlap portions of the respective product supporting track members on said first member.

2. The adjustable shelving unit defined in claim 1 wherein said product supporting track members are narrower than the bottom wall portions of said channels and are located therewithin such that uncovered bottom wall spaces extend along both opposite sides thereof adjacent said upstanding side wall portions, said shelving unit including openings formed through the bottom wall portions of said channels in said first and second members, said openings being positioned in said uncovered bottom wall spaces extending along and between the product supporting track members and the adjacent upstanding side wall portions.

3. The adjustable shelving unit defined in claim 1 wherein said end wall means associated with the first member includes a plurality of inverted arches uniformly disposed thereacross, one of said plurality of inverted arches being positioned respectively adjacent to one end of each of the channels formed within said first member, each of said inverted arches having a surface associated therewith to engage a product moved thereagainst.

4. The adjustable shelving unit defined in claim 1 including at least two track members positioned in and extending along each of the channels in said first and second members.

5. The adjustable shelving unit defined in claim 1 wherein said track members are integrally formed with the channels of said first and second members.

6. A product display and merchandising device adaptable to be supported on a support structure comprising a first member having front and rear edges and a floor portion extending therebetween, said floor portion being defined by a plurality of spaced channel portions and a plurality of upstanding wall portions positioned therebetween, a second member having front and rear edges and a floor portion extending therebetween, the floor portion of said second member being defined by a similar plurality of spaced channel portions and a similar plurality of upstanding wall portions positioned therebetween, a front wall portion extending substantially across the front edge of said first member, a rear wall portion extending substantially across the rear edge of said second member, the upstanding wall portions of said second member having cross-sectional shapes adaptable to slidably receive and telescopingly cooperate with the upstanding wall portions of said first member, said plurality of spaced channel portions associated respectively with said first and second members being in alignment with each other when said members are telescopingly engaged to form continuations thereof whereby said first and second members can be moved relative to each other to achieve a desired length between said front and rear wall portions, track means positioned in and extending along the channel portions in each of said first and second members to engage and support products positioned thereon, said track means being dimensioned such that uncovered floor spaces extend along opposite sides thereof adjacent said upstanding wall portions, the track means associated with said second member extending beyond the front edge thereof to overlap the track means associated with said first member, and means formed in the floor portions of said first and second members for enabling air to pass therethrough for circulation around rows of products positioned thereon.

7. The product display and merchandising device defined in claim 6 wherein said means formed in the floor portions of said first and second members include a plurality of apertures positioned within each of said channel portions, said apertures being positioned in the uncovered floor spaces extending along and between the opposite sides of said track means and the adjacent upstanding wall portions.

8. The product display and merchandising device defined in claim 6 wherein each of said track means includes an elongated member having a substantially flat base portion with a plurality of longitudinal runners extending outwardly from one side thereof, said runners extending in parallel relation in position to support and guide the movement of products positioned thereon.

9. The product display and merchandising device defined in claim 8 wherein said plurality of runners are formed of a material comprised of a mixture of a plastic substance and a lubricant material.

10. The product display and merchandising device defined in claim 9 wherein said runners are formed from a mixture of materials including an impact polystyrene and a silicone resin material, the silicone resin being present in a range from about 0.5% to 5% by weight.

11. The product display and merchandising device of claim 6 the support structure is oriented at an angle between about 3° to about 11° relative to the horizontal so that products positioned on the display and merchandising device will slide by gravity toward the front wall portion thereof.

12. A product display merchandising device adaptable to be supported on a support structure comprising a first member having front and rear edges and a floor portion extending therebetween, said floor portion being defined by a plurality of spaced channel portions and a plurality of wall dividers positioned therebetween extending between the front and rear edges, a second member having front and rear edges and a floor portion extending therebetween, the floor portion of said second member being defined by a similar plurality of spaced channel portions and a similar plurality of wall dividers positioned therebetween extending between the front and rear edges, means forming a first abutment surface extending substantially across the front edge of said first member, a second abutment surface extending substantially across the rear edge of said second member, the wall dividers of said first member having cross-sectional shapes adaptable to slidably receive and cooperate with the wall dividers of said second member to form adjustable length continuous channel portions extending between the rear abutment surface of said second member and the front abutment surface of said first member, said plurality of spaced channel portions associated respectively with said first and second members being in alignment with each other when said members are in cooperation with each other to form continuations thereof whereby said first and second members can be moved relative to each other to achieve a desired overall length for said spaced channel portions, track means positioned in and extending along the channel portions in each of said first and second members to engage and support products positioned thereon, said track means being narrower than said channel portions such that elongated spaced parallel floor portions are formed between both opposite sides of the track means in each channel portion and the adjacent wall dividers, and a plurality of apertures formed within each of said channel portions for enabling air to pass therethrough for circulation around products positioned thereon, said apertures being positioned in the spaced parallel floor portions along and between said track means and said adjacent wall dividers.

13. An adjustable shelving unit adaptable to be supported on a load carrying shelf having spaced front and rear edges and spaced side edges, said load carrying shelf to be adjustable to be in an inclined position supported by a plurality of vertical support members located adjacent to the front and rear edges thereof, said shelving unit comprising first and second members each being formed having a similar number of spaced parallel adjacent guide channels extending thereacross, front wall means forming an abutment surface extending across the front edge of said first member to stop the forward movement of products positioned thereon and rear wall means extending across the rear edge of said second member, said guide channels including bottom wall portions and spaced upstanding wall portions extending across said first and second members to form separators between said adjacent channels, the upstanding wall portions on said second member having cross-sectional shapes adaptable to slidably receive and telescopingly engage the upstanding wall portions on said first member, said plurality of guide channels associated respectively with said first and second members being in alignment with each other when said members are telescopingly engaged to form continuations thereof whereby said first and second members can be moved relative to each other to achieve a desired length for said guide channels, at least one track member positioned in and extending along each of said guide channels in each of said first and second members to engage and support products positioned thereon, said track members being narrower than said guide channels and being located therewithin such that uncovered bottom wall spaces are formed between the opposite sides of said track members and the adjacent upstanding wall portions, the track members on said second member extending beyond the front edge thereof to top the track members on said first member, opening means formed in the bottom wall portions of said guide channels outwardly of said track members in the spaces extending along and between the opposite sides of said track members and the adjacent upstanding wall portions to enable air to circulate therethrough and around products positioned therein, the vertical support members positioned adjacent to the rear edge of said load carrying shelf each including an elongated member having a plurality of vertically spaced attachment means formed therein, and means for attaching the load carrying shelf adjacent the rear edge thereof to the vertical support members, each of said means including an elongated formed wire member having a first loop portion engagable with the load carrying shelf adjacent the rear edge thereof and a second loop portion angularly related to the first loop portion engagable with a selected one of the vertically spaced attachment means on one of said vertical support members.

14. The adjustable shelving unit defined in claim 13 including a pair of hanger members hingedly attached to said load carrying shelf adjacent to opposite ends of the rear edge thereof, each of said hanger members having an opening therethrough adaptable to receive the first loop portion of respective ones of said elongated formed wire members.

15. A two-piece telescoping shelf construction for supporting products in parallel rows comprising a first member having front and rear edges and a floor portion extending therebetween, said floor portion being defined by a plurality of spaced channel portions and a plurality of wall dividers positioned therebetween, a second member having front and rear edges and a floor portion extending therebetween, the floor portion of said second member being defined by a similar plurality of spaced channel portions and a similar plurality of wall dividers positioned therebetween, front wall means extending substantially across the front edge of said first member and rear wall means extending substantially across the rear edge of said second member, the wall dividers of said first member having cross-sectional shapes adaptable to slidably receive and telescopingly cooperate with the wall dividers of said second member to form adjustable length continous channel portions extending between the rear wall means of said second member and the front wall means of said first member, said plurality of spaced channel portions associated respectively with said first and second members being in alignment with each other when said members are placed in cooperation with each other to form continuations thereof whereby said first and second members can be moved relative to each other to achieve a desired overall length for said spaced channel portions between the front wall means of the first member and the rear wall means of the second member, elevated product supporting track means including a central track portion positioned in and extending along the channel portions in each of said first and second members to engage and support products positioned thereon, said central track portion being narrower than said channel portions and being located within said channel portions such that elongated spaced parallel floor portions are formed therealong on opposite sides of the central track portion in each channel portion between the opposite sides thereof and the adjacent wall dividers, and a plurality of apertures formed within each of said channel portions for enabling air to pass therethrough for circulation around rows of products positioned therewithin, said apertures being positioned in the elongated spaced floor portions.

16. The shelf construction defined in claim 15 wherein said track means are integrally formed with said channel portions.

17. An adjustable shelving unit for merchandising products arranged in rows comprising first and second members each having spaced opposed front and rear edges, spaced opposed side edges, and a floor portion extending therebetween, a plurality of upstanding wall portions extending between the front and rear edges of said first and second members at spaced locations thereacross dividing said members into a similar plurality of product supporting channels extending thereacross, front wall means extending substantially across the front edge of said first member and rear wall means extending substantially across the rear edge of said second member, the upstanding wall portions on said second member having cross-sectional shapes adaptable to slidably receive and telescopingly cooperate with the upstanding wall portions on said first member, said plurality of product supporting channels associated with said first member being in alignment with said plurality of product supporting channels associated with said second member when said members are placed in cooperation with each other to form continuations thereof whereby said first and second members can be moved relative to each other to enable adjusting the overall length of said product supporting channels between the front wall means on said first member and the rear wall means on said second member to accommodate varying shelf depths, a pair of elongated runners positioned respectively in and extending along each of the product supporting channels in said first and second members, each of said pairs of elongated runners being located within said product supporting channels such that spaced elongated exposed floor areas are formed in each channel along opposite sides of the runners therein and between said runners, and a plurality of aperatures formed in each of the product supporting channels for enabling air to pass therethrough for circulation around products positioned therein, said apertures being positioned in the elongated exposed floor area formed between each pair of elongated runners.

18. The adjustable shelving unit defined in claim 17 wherein additional apertures are positioned in the spaced elongated exposed floor areas extending respectively along said elongated runners adjacent said upstanding wall portions.

19. The adjustable shelving unit defined in claim 17 wherein the front wall means associated with said first member includes a plurality of inverted arches uniformly disposed thereacross, one of said plurality of inverted arches being positioned respectively adjacent to one end of each of said product supporting channels formed within said first member, each of said inverted arches having a surface associated therewith to engage a product moved thereagainst.

* * * * *